US008511363B2

(12) United States Patent
Lin

(10) Patent No.: US 8,511,363 B2
(45) **Date of Patent: *Aug. 20, 2013**

(54) WINDOW COVERING

(75) Inventor: Tzong-Fu Lin, Taipei (TW)

(73) Assignee: Whole Space Industries Ltd., Taipei (TW)

( * ) Notice: Subject to any disclaimer, the term of this patent is extended or adjusted under 35 U.S.C. 154(b) by 0 days.

This patent is subject to a terminal disclaimer.

(21) Appl. No.: 13/371,651

(22) Filed: Feb. 13, 2012

(65) Prior Publication Data

US 2012/0175067 A1 Jul. 12, 2012

Related U.S. Application Data

(63) Continuation of application No. 12/755,477, filed on Apr. 7, 2010, now Pat. No. 8,113,261.

(51) Int. Cl.
*A47H 5/00* (2006.01)

(52) U.S. Cl.
USPC ..... 160/84.01; 160/89; 160/108

(58) Field of Classification Search
USPC ..... 160/108, 89, 84.01
See application file for complete search history.

(56) References Cited

U.S. PATENT DOCUMENTS

| | | | |
|---|---|---|---|
| 1,321,800 | A | 11/1919 | Andress et al. |
| 2,267,869 | A | 12/1941 | Loehr |
| 2,586,340 | A | 2/1952 | Hyde |
| 2,678,094 | A | 5/1954 | Sargent |
| 3,487,875 | A | 1/1970 | Shukat et al. |
| 4,096,904 | A | 6/1978 | Donofrio |
| 4,681,279 | A | 7/1987 | Nakamura |
| 4,909,298 | A | 3/1990 | Langhart et al. |
| 5,205,334 | A | 4/1993 | Judkins |
| 5,482,105 | A | 1/1996 | Rude |
| 5,533,559 | A | 7/1996 | Judkins |
| 5,566,735 | A | 10/1996 | Jelic |
| 5,630,458 | A | 5/1997 | Holden |
| 5,787,951 | A | 8/1998 | Tonomura et al. |
| 6,431,248 | B1 | 8/2002 | Hyman et al. |
| 6,484,787 | B1 | 11/2002 | Walters |
| D468,950 | S | 1/2003 | Judkins |
| D473,743 | S | 4/2003 | Judkins |
| 6,637,493 | B1 | 10/2003 | Lampers |
| 6,644,376 | B2 | 11/2003 | Wielen |
| 6,662,845 | B1 | 12/2003 | Palmer |
| 6,712,115 | B2 | 3/2004 | Judkins |
| 6,817,399 | B2 | 11/2004 | Berman et al. |
| 6,854,504 | B2 | 2/2005 | Nien |
| 6,860,312 | B2 | 3/2005 | Judkins |
| 6,918,425 | B2 | 7/2005 | Nien |
| 6,948,546 | B2 | 9/2005 | Nien |
| 6,988,526 | B2 | 1/2006 | Judkins |

(Continued)

*Primary Examiner* — Blair M. Johnson
(74) *Attorney, Agent, or Firm* — Buchanan Ingersoll & Rooney PC

(57) ABSTRACT

A window covering includes a roller attached to a mounting device and an actuation device attached to the roller to rotate the roller in at least one of a first direction and a second direction. A front member is attached to the mounting device. A second member is attached to the roller. A plurality of ballast members are attached to the front member. Each ballast member has a portion that extends to the second member to engage the second member to cause the front member to form substantially parallel folds when the second member is wound about the roller to retract the front member to a retracted position. Preferably, the folds are similar to or exactly like the transverse folds in shade material that are formed when a conventional Roman shade is raised.

5 Claims, 5 Drawing Sheets

(56) References Cited

U.S. PATENT DOCUMENTS

| | | | |
|---|---|---|---|
| 7,000,672 | B2 | 2/2006 | Nien |
| 7,086,446 | B2 | 8/2006 | Kollman et al. |
| 7,117,918 | B2 | 10/2006 | Franssen |
| 7,124,802 | B2 | 10/2006 | Sudano |
| 7,225,850 | B2 | 6/2007 | McCarty et al. |
| 7,261,138 | B2 | 8/2007 | Judkins et al. |
| 7,318,251 | B2 | 1/2008 | Lin |
| 7,624,784 | B2 | 12/2009 | Anthony et al. |
| 2006/0060308 | A1 | 3/2006 | LeBlanc et al. |
| 2006/0144526 | A1 | 7/2006 | McGinley |
| 2006/0157204 | A1 | 7/2006 | Lin |
| 2007/0023149 | A1 | 2/2007 | Lamars et al. |
| 2007/0175593 | A1 | 8/2007 | Lin |
| 2008/0110581 | A1 | 5/2008 | Lin |
| 2008/0223530 | A1 | 9/2008 | Grosso |
| 2008/0277074 | A1 | 11/2008 | Lin |
| 2008/0295975 | A1 | 12/2008 | Lin |
| 2009/0266496 | A1 | 10/2009 | Dann et al. |
| 2010/0263808 | A1 | 10/2010 | Hanley et al. |
| 2011/0067820 | A1 | 3/2011 | Hsu et al. |
| 2011/0247761 | A1 | 10/2011 | Lin |
| 2011/0247762 | A1 | 10/2011 | Lin |
| 2011/0247765 | A1 | 10/2011 | Lin |
| 2012/0175067 | A1 | 7/2012 | Lin |

WINDOW COVERING

CROSS-REFERENCE TO RELATED APPLICATION

The present application is a continuation application of U.S. patent application Ser. No. 12/755,477, which was filed on Apr. 7, 2010.

FIELD OF INVENTION

The present invention relates to window coverings such as blinds or shades.

BACKGROUND OF THE INVENTION

One popular type of window covering is known as a Roman shade which may also be called a Roman blind, an Austrian shade, a Balloon Shade, or a Soft Shade. This type of shade consists of a panel or sheet of material attached along its top edge to a headrail and gathered at spaced intervals to provide a series of soft transverse folds across the face of the fabric. Consequently, the typical Roman shade has a cascaded or softly pleated appearance. Such Roman shades are usually constructed so that when they are raised from an extended position, they gather from the bottom in generally horizontal folds or pleats until the entire shade resides near the top of the window covering in a retracted position. Often, ballast members such as metal rods or metal bars are positioned within pockets form in the shade material to provide weight to the shade to form the soft transverse folds. The Roman shades are often operated by pulling on various lift cords which are used in conjunction with guides attached to the shade.

In other versions of Roman shades, such as a Roman shade product sold under the AudraGuard name, the shades are operated by pulling on a beaded looped cord of a loop cord drive. Actuation of the loop cord drive causes a shaft or roller to rotate to wind or unwind a plurality of lifting tapes that pass through metal clips or loops attached to the rear face of the shade material and have a terminal end attached to a bottom portion of the shade material. The winding of the lifting tapes causes the shade material to be raised, or retracted. The unwinding of the lifting tapes causes the shade material to lower, or extend.

Most prior art Roman shades have window covering material that is formed either of a sheet of a flexible material such as a fabric or film, a plurality of segments of material connected together, or woven wood. The material or interconnected segments are typically provided with a plurality of horizontal folds at points vertically spaced from one another to form folds when the shade is raised. A common method for making a Roman shade is to sew or attach at least two sets of rings or connectors along vertical lines down the back of the fabric material as is shown in U.S. Pat. No. 1,321,800. The spacing of the rings or connectors affects the aesthetic effect of the shade and how the window covering material may look when being raised or lowered. Lift cords pass through the rings and each lift cord is attached to a bottom rail or the lowermost fold. Opposite ends of the lift cords are wound on a spool or shaft in the headrail. The spool or shaft may be turned by a cord loop device or a spring motor to raise and lower the shade. Alternatively, the lift cords may pass through a cord lock and be moved by a user to turn the spool or shaft.

The shade may also include spacer cords that pass through the rings. The spacer cords are typically attached to the headrail of the shade and the rings and are configured to help improve the aesthetic effect of the shade when the window covering material is raised or lowered. A liner may also be included in such shades. Additionally, Roman shades may be configured as a top down bottom up shade. Roman shades may also have other configurations, such as the configurations disclosed in U.S. Pat. Nos. D473,743, D468,950, and 7,624,784, 6,988,526, 6,662,845, and 5,787,951 and U.S. Patent Application Publication Nos. 2008/0295975, 2008/0277074, 2007/0175593, 2006/0060308 and 2006/0157204.

Roman shades may be fabricated by fabricators to make a Roman shade in a custom size to fit a customer's window opening. Fabricators may mistakenly measure or determine the necessary length of the window covering material of a Roman shade or the desired positioning of the rings on the back of the window covering material. For instance, a fabricator may want to adjust the position of the rings to achieve a different aesthetic effect for the raising and lowering of window covering material after reviewing the look provided by the initial positioning of the rings. Since rings are often sewn or affixed to the window covering material, such repositioning can be difficult and time consuming. Alternatively, Roman shades may include fastening mechanisms that permit fabricators to more easily adjust the position of the window covering material relative to the lift cords to which the window covering is attached. Examples of such devices are disclosed in U.S. Pat. Nos. 6,817,399 and 5,566,735.

On occasion, children have been able to get behind a lowered Roman shade and become entangled in one of the lift cords. If the lift cord is around the child's neck and the child falls, the cord could act as a noose and strangle the child. Indeed, reports of such incidents have prompted a major retailer to issue a recall of one product line of Roman shades and the United States Consumer Product Safety Commission has issued a warning about the danger of child entanglement and hanging from the cords in Roman shades.

There have also been incidents of child entanglements in lift cords of venetian blinds and other types of window coverings. As a result, the art has developed various types of child safety devices that are intended to prevent deaths of children who become entangled in lift cords. For instance, U.S. Pat. Nos. 7,318,251, 7,261,138, 7,225,850, 7,117,918, 7,086,446, 7,000,672, 6,948,546, 6,918,425, 6,860,312, 6,637,493, 6,484,787, 6,431,248, 5,630,458, 5,533,559 and 4,909,298 and U.S. Patent Application Publication Nos. 2008/0110581, 2007/0023149 and 2006/0144526 disclose child safety devices for blinds. Child safety devices may be configured to keep the lift cords taught so that the cords cannot be pulled away from the window covering material and form a noose or release the cord from the shade when a child becomes entangled in the shade. Most, if not all of the cord release devices are not well suited for use on Roman shades. Moreover, many conventional child safety devices for window coverings are visible from the front of the shade and detract from the aesthetic effect of the shade.

A new window covering is needed to replace or change a conventional Roman shade design that utilizes exposed lift cords or lifting tape. Preferably, such a window covering can prevent lift cords or lifting tape used for raising and lowering a shade from coming into contact with a small child. Moreover, such a window covering preferably provides the same or a substantially similar aesthetic effect provided by conventional Roman shades while also providing aesthetic advantages to the rear face, or window facing face, of the window covering.

SUMMARY OF THE INVENTION

A window covering is provided that includes a mounting device, a roller attached to the mounting device, an actuation device attached to the roller, a front member attached to the mounting device, a second member attached to the roller, and a plurality of ballast members attached to the front member. The roller is moveable in a first direction and a second direction opposite the first direction. The front member is comprised of window covering material. An upper portion of the front member is attached to the mounting device. The front member is moveable from a retracted position, or raised position, to an extended position, or lowered position. The second member is also comprised of window covering material. An upper portion of the second member is attached to the roller so that rotation of the roller in the first direction winds the second member about the roller to retract the second member and rotation of the roller in the second direction unwinds the second member from the roller to extend the second member. A lower portion of the second member is attached to a lower portion of the front member. The second member has a first side and a second side opposite the first side. The ballast members each have a first end portion, a second end portion opposite the first end portion and a first middle portion between the first and second end portions. The first middle portion of each ballast member is attached to the front member. The first end portion of each ballast member extends from the first middle portion to the second member to engage the second side of the second member. The second end portion of each ballast member extends from the middle portion to the second member to engage the second side of the second member. The ballast members are positioned so that each ballast member is substantially parallel to other ballast members. The first and second end portions of each ballast member are sized and configured to cause the front member to form substantially parallel folds when the second member is wound about the roller to retract the front member to the retracted position.

The mounting device may include one or more components sized and configured to mount the front member and the second member adjacent to a window opening. Preferably, the mounting device is a headrail attached to mounting brackets. It is contemplated that the mounting device may alternatively be the middle moveable rail of a top down bottom up shade that is attached to a headrail. It is also contemplated that the mounting device may be a plurality of brackets for attachment to a window opening frame for holding the roller. For instance, two spaced apart brackets may be the mounting device. The brackets may be sized and configured to hold stub end portions of a roller or may have projections for insertion into one or more openings formed in a roller for attachment to the roller and for mounting the roller, the front member and the second member adjacent to a window or window opening.

The actuation device may include components for actuating rotation of the roller. The actuation device may include a loop cord derive attached to the roller, a spring clutch mechanism attached to the roller, or a spring clutch mechanism attached within a roller. A friction brake may also be attached to the roller. Of course, other embodiments of the window covering may include other control mechanisms attached to the roller.

The actuation device may be configured to actuate rotation of the roller in only one direction. For example, the actuation device may only be configured to move the roller so the roller rotates in the first direction or only move the roller so the roller rotates in the second direction. Alternatively, the actuation device may be configured to actuate rotation of the roller in the first direction and in the second direction. For instance, the actuation device may include a loop cord drive. Movement of the loop cord in one direction may move the roller in the first direction and movement of the loop cord in the opposite direction may move the roller in the second direction.

In some embodiments, the front member and second member may be arranged so that retraction of the front member is simultaneous with retraction of the second member.

The first direction may be clockwise and the second direction may be counter clockwise. In alternative embodiments, the first direction may be counter clockwise and the second direction may be clockwise.

The window covering material of the front member may be any suitable material. For instance, the window covering material of the front member may be fabric, interconnected fabric segments, woven wood, or woven grass. The window covering material of the second member may also be any suitable type of material. For instance, the window covering material of the second member may be a sheet of fabric, a sheet of non-woven fabric, a sheet of material, a film, a sheet of mesh material, or a sheet of plastic. Preferably, the second member has a width that is substantially equal to or equal to the length of the roller and also has a length that defines how low the front member may be retracted, or lowered. The length of the roller is a larger value than the width or height of the roller or is a larger value than the diameter of the roller.

The roller may be a tube, a shaft or a generally cylindrical structure. For instance, the roller may be a cylindrical structure that includes stub portions that extend from the ends of the roller for attachment to the mounting device. As another example, the roller may be a shaft that has a rectangular or polygonal cross section.

In some embodiments, each ballast member may also include a second middle portion that is attached between the first and second end portions of that ballast member. The second middle portion may be positioned to engage the second side of the second member when the front member is moved to the retracted position. Such engagement may help form folds in the front member. Preferably, such folds are similar to or exactly like folds formed when a conventional Roman shade is raised. The second middle portion of each ballast member may be parallel to the first middle portion.

In some embodiments, each ballast member may be shaped like a C or have a generally C-like shape. For instance, the end portions may be curved and a first middle portion may be generally straight. Alternatively, the ballast members may each be shaped to form a generally rectangular shape or a generally elliptical shape. Of course, other embodiments of the window covering may use ballast members of other shapes or configurations.

The first side of the second member may face toward the front member and the second side of the second member may face toward a window of a window opening. For such embodiments, the first side may define a front face of the second member and the second side may define a rear face of the second member. The front member may be positioned to fully cover the first side of the second member. It is also contemplated that the front member may only partially cover the first side of the front member.

In other embodiments of the window covering, the window covering may include a mounting device, a roller attached to the mounting device so that the roller is rotatable in a first direction and a second direction, an actuation device attached to the roller, a front member attached to the mounting device and a second member attached to the roller. The actuation device may be configured to move the roller to rotate the roller in at least one of the first direction and the second direction. The bottom portion of the second member is attached to the bottom portion of the front member. The second member is attached to the roller so that the second member is windable about the roller when the roller rotates in the first direction and is unwindable from the roller when the roller rotates in the second direction. The window covering also includes a plurality of generally U-shaped members. Each U-shaped member has a first end portion, a second end portion and a middle portion between the first and second end portions. The first end portion of each U-shaped member is attached to the front member. The second end portion of each U-shaped member extends from the middle portion to the second member to engage a side of the second member. Each U-shaped member is positioned such that each U-shaped member is substantially parallel to other U-shaped members. The second end portions of the U-shaped members are sized and configured to cause the front member to form substantially parallel folds when the second member is wound about the roller to retract the front member to the retracted position.

Other details, objects, and advantages of the invention will become apparent as the following description of certain present preferred embodiments thereof and certain present preferred methods of practicing the same proceeds.

BRIEF DESCRIPTION OF THE FIGURES

Present preferred embodiments of my Roman shade are shown in the accompanying drawings and certain present preferred methods of practicing the same are also illustrated therein.

DESCRIPTION OF PRESENT PREFERRED EMBODIMENTS

Figure 1:
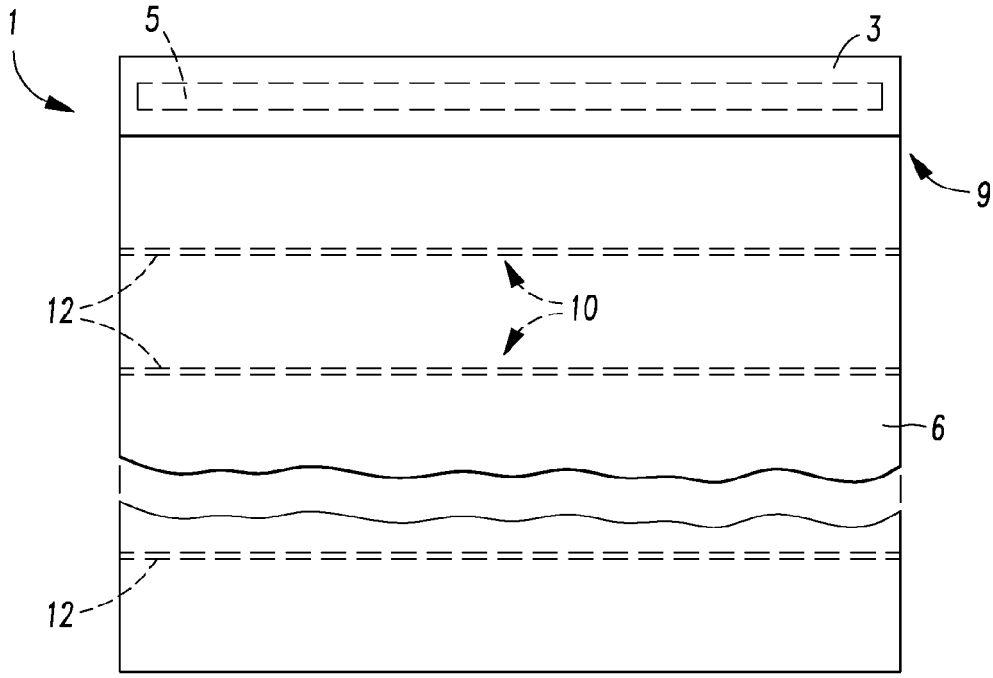
FIG. 1 is a front view of a first present preferred window covering in an extended position, or lowered position.
Figure 3:
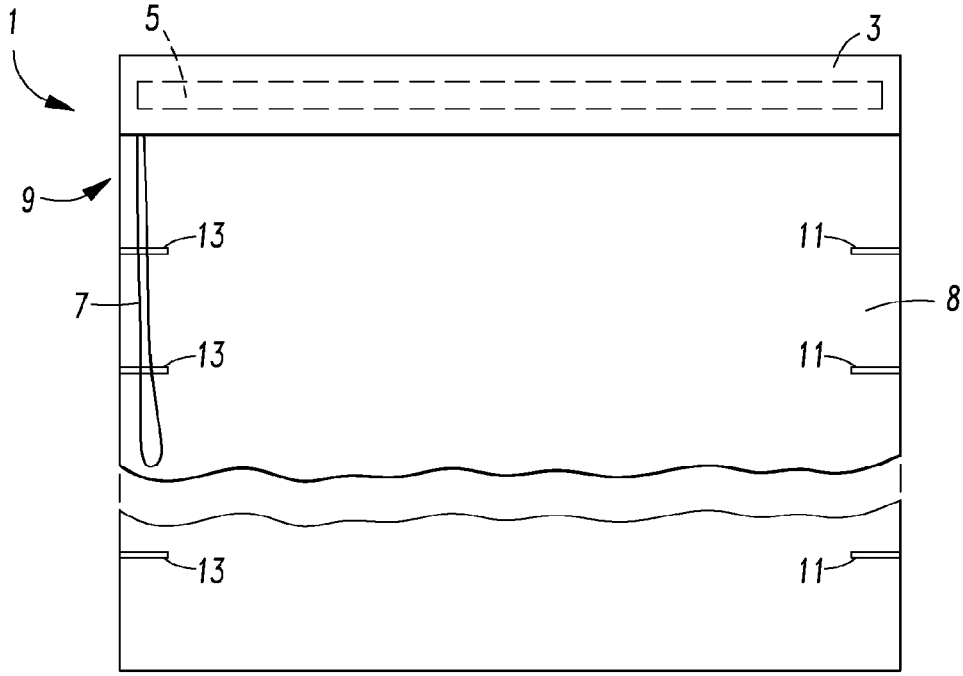
FIG. 3 is a rear view of the first present preferred window covering in an extended position, or lowered position.
Figure 2:
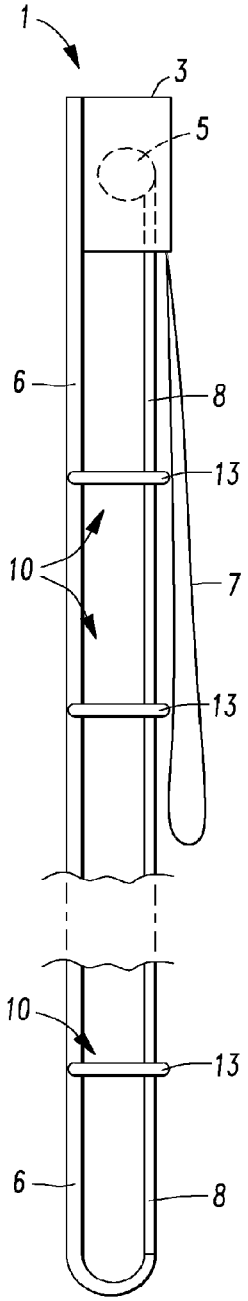
FIG. 2 is a side view of the first present preferred window covering in an extended position, or lowered position.

Referring to FIGS. 1-3, a window covering 1 may include a headrail 3 and a front member 6 composed of window covering material that is attached to the headrail 3. An upper portion of the front member 6 is attached to the headrail 3. The front member 6 is moveable from a retracted position, or raised position, to an extended position, or lowered position. The front member may be composed of window covering material such as fabric, interconnected fabric segments, woven wood, woven grass or other material. An actuation device 9 is attached to the headrail and a roller 5 is attached to the headrail. A second member 8 is attached to the roller 5.

Preferably, the front member 6 is positioned so an uncovered side of the front member faces an interior portion of a room when the window covering 1 is mounted adjacent to a window or window opening and the second member 8 is positioned so a side of the second member 8 faces toward a window when the window covering 1 is mounted adjacent to a window or window opening. Though less preferred, it is also contemplated that the font member may have an uncovered side that faces the window when the window covering 1 is mounted adjacent to a window or window opening and the second member 8 may have an uncovered side that faces toward an interior portion of a room when the window covering 1 is mounted adjacent to a window or window opening.

The roller 5 is rotatable in a first direction and in a second direction that is opposite the first direction. For instance, the first direction may be clockwise and the second direction may be counter clockwise. As another example, the first direction may be counter clockwise and the second direction may be clockwise.

The actuation device 9 is attached to the roller so that the actuation device 9 may move the roller in a first direction and in a second direction. For instance, the actuation device 9 may be a loop cord drive that includes a looped cord 7. As will be well understood by those of at least ordinary skill in the art of window coverings, one example of such a loop cord drive may be appreciated from U.S. Pat. No. 5,482,105. The looped cord 7 may be moved in one direction to rotate the roller in the first direction and may also be moveable in an opposite direction to rotate the roller in the second direction. The looped cord may be beaded with beads that are sized and configured to mate within a rotatable element of the looped cord drive as is common in loop cord drives. A portion of the looped cord drive may be attached to the roller to rotate the roller in the first direction and in the second direction. For example, the loop cord drive could include a projecting member sized and configured to fit within an opening in an end of the roller for attaching the loop cord drive to the roller. That projection may be configured to rotate via movement of the loop cord 7 to rotate the roller.

The roller may be a cylindrical structure, a shaft, a tube, or an elongated member that has a circular, elliptical, or generally polygonal cross section. The roller may have a diameter or a width that is defined by the thickness of the cross section or the size of the diameter of the roller. The length of the roller may be its longest dimension. The length of the roller may be sized and configured to receive a second member 8 so that the second member 8 is windable about the roller. It is contemplated that the roller could include stub portions that extend from the ends of the roller. Such stub portions may not be configured to receive and hold a portion of the second member 8.

The second member 8 is preferably as wide as the length of the roller portion that is sized and configured to receive and wind the second member 8 about the roller. Such a width of the second member 8 may be considered to be a width that is substantially equal to the length of the roller. For example, the length of the roller portion that is sized and configured to receive and wind the second member may not include the lengths from stub end portions that are not configured to retain any material when the roller is rotated for purposes of determining whether the width of the second member is substantially equal to the length of the roller. A second member may have a width that is equal to the length of the roller minus the length of the stubbed end portions (e.g. [width of second member]=[length of roller]−[combined length of stub end portions]). Such a width of the second member would be substantially equal to the length of the roller 5.

The second member 8 has an upper portion that is attached to the roller so that the second member is windable about the roller 5 and is unwindable about the roller 5. The second member 5 may be wound about the roller 5 when the roller rotates in one direction and may be unwound about the roller 5 when the roller rotates in an opposite direction.

The second member 8 is preferably composed of window covering material. Such window covering material may be a fabric sheet, a non-woven fabric sheet, a sheet composed of interconnected fabric segments, a film, a flexible plastic sheet, a mesh sheet, a sheet with preformed holes, or other material. The second member may have a window facing side that has a desired coloration or a particular configuration to provide a desired aesthetic effect for the window facing side of the window covering 1.

A plurality of ballast members 10 are attached to the front member 6. Each ballast member 10 includes a middle portion 12 and end portions 11 and 13 opposite the middle portion. The middle portions 12 may be positioned within pockets formed in the front member or may be otherwise attached to the front member. In one contemplated alternative, the ballast member may be attached by clips attached to a rear facing side of the front member 6, which faces toward the second member 8.

Figure 7:
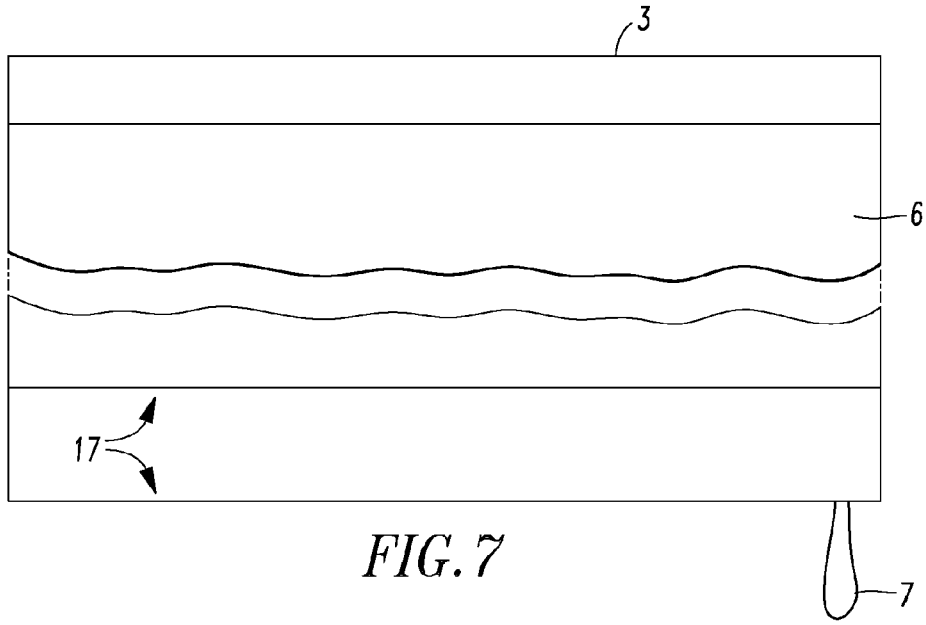
FIG. 7 is a front perspective view of the first present preferred embodiment of the window covering in a retracted position, or raised position.

Preferably, the ballast members 10 are composed of metal such as steel, but the ballast members 10 may be composed of other materials as well. The ballast member 10 are sized and configured to provide a desirable amount of weight to different portions of the front member. Such weight may help the ballast members cause the front member to form multiple folds when the front member 6 is retracted to a raised position, as may be appreciated from FIGS. 7-9.

The first end portion 11 and second end portion 13 of each ballast member 10 extends from the middle portion 11 to engage a portion of the second member 8. Preferably, the end portions engage a window facing side of the second member 8. The engagement between the end portions 11 and 13 and the second member 8 cause the front member 8 to form transverse folds when the front member 6 and second member 8 are retracted similar to the folds 17 formed when a conventional Roman shade is raised. Preferably, the folds that are formed look exactly like the folds formed when a conventional Roman shade is raised or look substantially like folds formed when a conventional Roman shade is raised.

Figure 8:
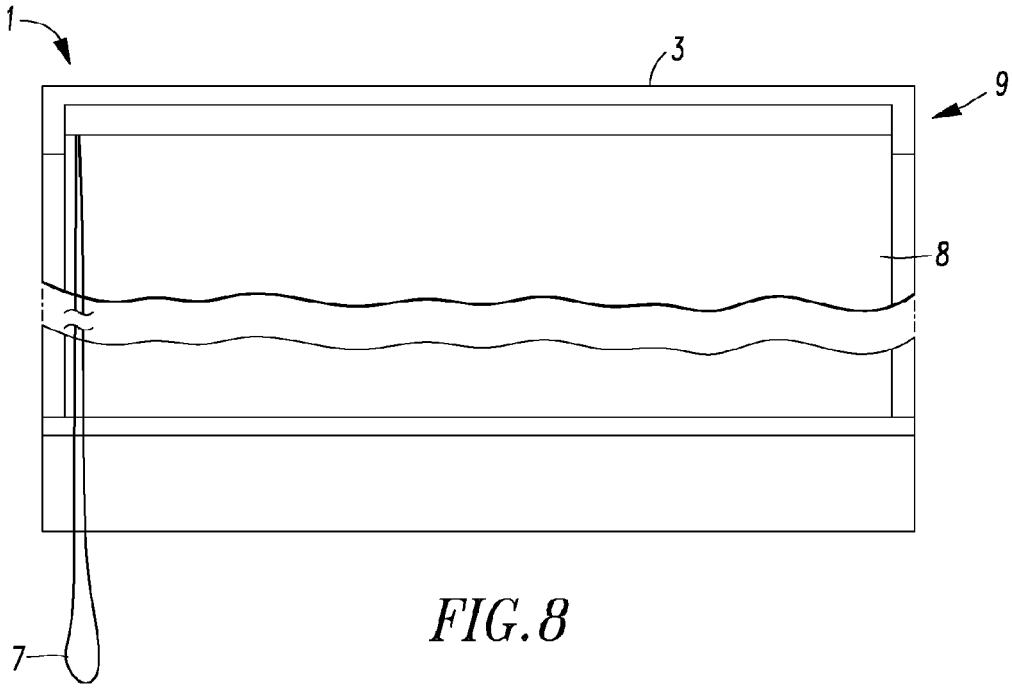
FIG. 8 is a rear perspective view of the first present preferred embodiment of the window covering in a retracted position, or raised position.
Figure 9:
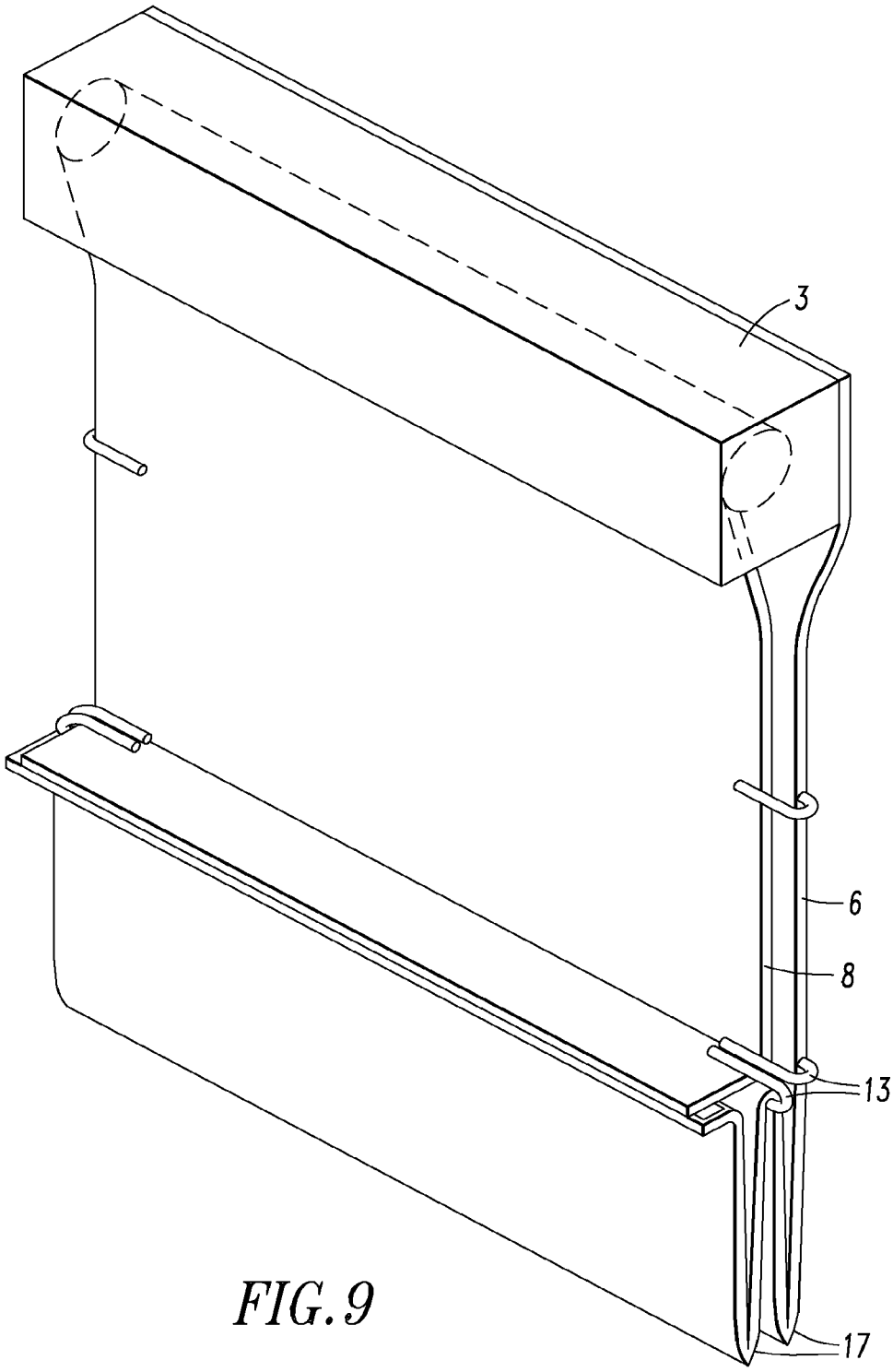
FIG. 9 is a side perspective view of the first present preferred embodiment of the window covering in a retracted position, or raised position.

As may be appreciated from FIGS. 8 and 9, the ballast members 10 may be positioned adjacent to each other when the window covering is positioned in a raised or retracted position. The ends of the ballast members 10 may be positioned in series with other ballast members and may engage or contact adjacent ballast member end portions when the window covering is in the raised position.

The ballast members are sized and configured to help form folds in the front member 6 when the front member is retracted. As may be appreciated from FIGS. 4, 5 and 6, ballast members that may be used in embodiments of the window covering can have different shapes and sizes.

Figure 4:
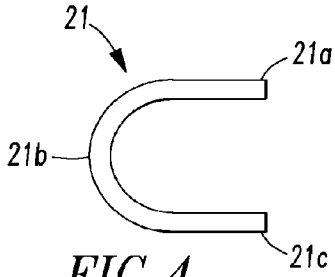
FIG. 4 is a top view of a first present preferred ballast member that may be used in embodiments of the window covering.

As may be appreciated from FIG. 4, a ballast member 21 may have a generally U-like shape or be generally U-shaped. Such a U-shaped member has a first end portion 21*a*, a second end portion 21*c* and a middle portion 21*b* attached between the first and second end portions 21*a* and 21*c*. There may be a two columns of parallel U-shaped members positioned adjacent the opposite vertical edges of the front member 6 so that one end portion of the U-shaped member 21 extends from the middle portion 21*b* and engages the window facing side of the second member 8 to help cause the front member 6 to form transverse folds when the front member is retracted as noted above and illustrated in FIGS. 7-9. Preferably, each ballast member is an integral structure cast or formed of metal.

Figure 5:
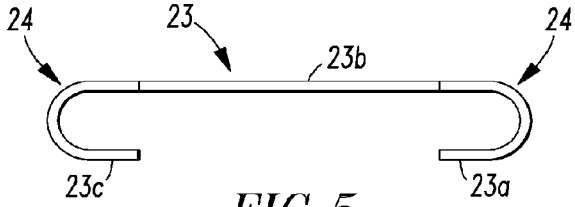
FIG. 5 is a top view of a second present preferred ballast member that may be used in embodiments of the window covering. Dotted lines in FIG. 5 illustrate an end portion of the generally U-shaped end portions of the ballast member.

Referring to FIG. 5, a ballast member 23 may alternatively be used in embodiments of the window covering 1. Such ballast members 23 may have a generally C shape or be generally C-shaped. Each ballast member 23 has a first end portion 23*a*, a second end portion 23*c* and a middle portion 23*b* attached between the end portions. It should be understood that each ballast member 23 may include two generally U-shaped members 24 as each end portion 23*a* and 23*c*. The generally U-shaped members are attached together via the middle portion 23*b*.

The ballast members 23 may be attached to the front member 6 similarly to the ballast members 10 shown in FIGS. 1-3. For example, the middle portion 23*b* of each ballast member 23 may be within a respective pocket formed in the front member 6 or may be otherwise attached to the front member 6. Preferably, each ballast member 23 is an integral structure cast or formed of metal.

Figure 6:
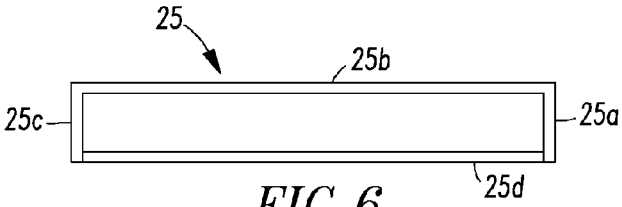
FIG. 6 is a top view of a third present preferred ballast member that may be used in embodiments of the window covering.

Referring to FIG. 6, another alternative ballast member 25 configuration may include a ballast member 25 that has a first end portion 25*a* and a second end portion 25*c*. A first middle portion 25*b* may be attached between the first and second end portions 25*a* and 25*c*. A second middle portion 25*d* may also be attached between the first and second end portions 25*a* and 25*c*. Preferably, the first middle portion 25*b* and the second middle portion 25*d* extend between the end portions such that they are parallel to each other. The first middle portion 25*b* may be positioned within a pocket in the front member similar to middle portions 12 shown in FIG. 1. The second middle portion 25*d* may then be attached to the end portions 25*a* and 25*c* so that the second middle portion 25*d* engages the rear side of the second member 8 to help cause transverse forms to be formed similar to the folds discussed above and shown in FIGS. 7-9. The second middle portion 25*d* may be attached to end portions 25*a* and 25*c* via mating male members and female openings formed on the end portions and ends of the second middle portion 25*d*. As another alternative, the second middle portion may be attached via other fastening mechanisms to the end portions such as, for example, welding, adhesives, clips or other fastening devices.

Figure 10:
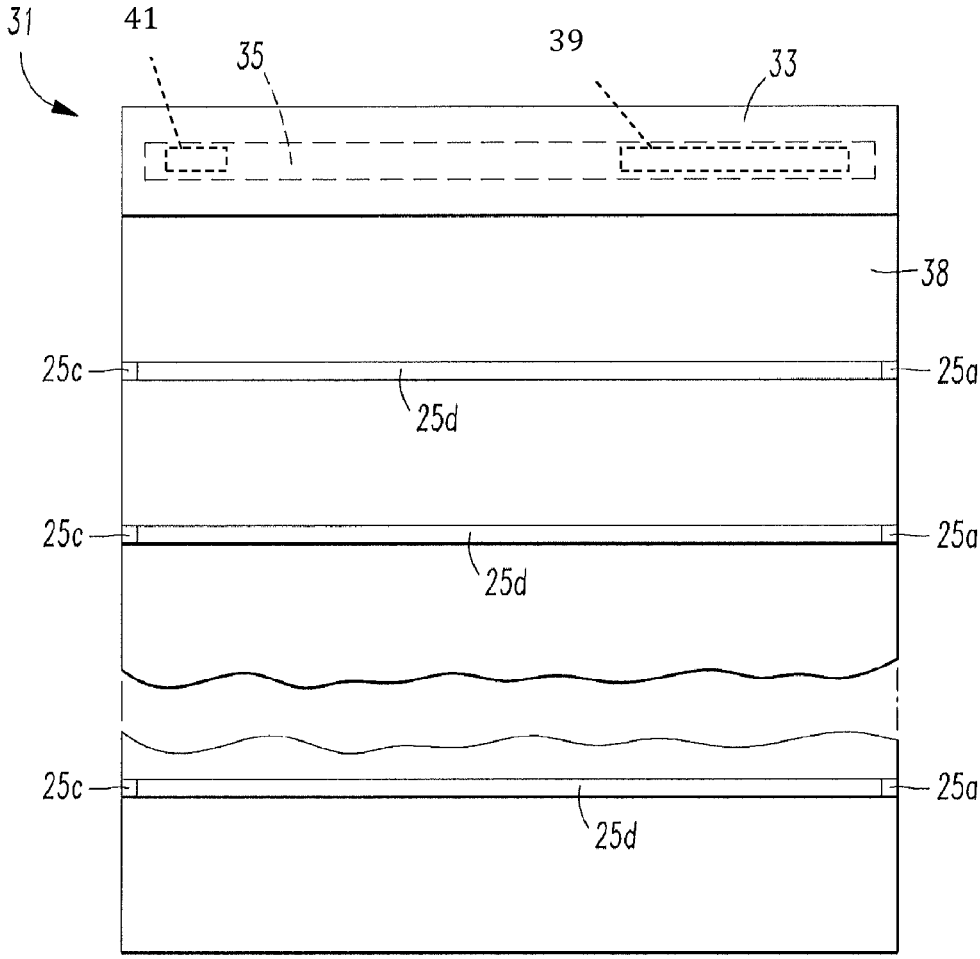
FIG. 10 is a rear view of a second present preferred embodiment of the window covering in an extended position, or lowered position.

Referring to FIG. 10, a second embodiment of the window covering 31 is shown. The window covering 31 includes a headrail 33 that has a roller tube 35 attached within the headrail 33. The roller tube includes a spring clutch mechanism 39 or other control mechanism for controlling the height of the front member (not shown) and second member 38. A plurality of ballast members 25 are attached to the front member (not shown) so that the second middle portion 25*d* of each ballast member engages a portion of the second member to help cause the front member to form folds when the front member is retracted. End portions 25*c* and 25*a* may also include a portion that engages the second member.

The spring clutch mechanism may be attached to the roller tube 35 or may be attached within a central channel or other opening formed in the roller tube 35. As an alternative, or in addition, a friction brake 41 may also be attached to the roller tube in combination with a spring for powering rotation of the roller in a take up direction. The brake may be configured for actuation to stop movement of the roller for maintaining user selected positions of the window covering.

The spring clutch mechanism may be configured so that a user may pull down on the front member (not shown) or the second member 38 of the window covering 31 to lower the window covering to a desired position. After being moved to a desired position, the spring clutch may be configured to maintain the position of the window covering at that desired position. If a user wishes to raise the window covering, the user may pull down slightly on the front member (not shown) or second member 38 to disengage the clutch or the friction brake so that the spring mechanism may cause the roller tube to rotate in a direction to wind the second member and retract the second member 38 and the front member (not shown) such that the front member forms folds similar to the folds shown in FIGS. 7-9. Preferably, these folds look like folds formed when a conventional Roman shade is raised. A new raised position of the window covering may be set by a user and the user may then adjust the window covering height until the clutch is reengaged to hold the new position.

It should be appreciated that the control mechanism attached to the roller tube 35 may work similarly to the shade control mechanisms disclosed in U.S. Pat. Nos. 2,586,340, 2,678,094, 4,096,904, or 4,681,279, or other spring powered shade control mechanisms or take up mechanisms commonly used in roller shades such as spring clutch mechanisms, springs coupled to ratchet and pawl arrangements for locking positions of the roller, spring and brake arrangements for cordless positioning of shade material, and other arrangements. The entirety of U.S. Pat. Nos. 2,586,340, 2,678,094, 4,096,904, and 4,681,279 are incorporated by reference herein as disclosing examples of such control mechanisms and other spring powered shade control mechanisms that may be attached to the roller tuber 35 or may be attached within roller tube 35.

It should be understood that embodiments of my window covering may permit a window covering to look like a Roman shade and provide an aesthetic effect that is exactly like, or at least comparable, to a Roman shade without using any lifting tapes or lift cord portions for raising and lowering the window covering. The non-use of lifting tape or lift cords improve the safety of the window covering by eliminating a potential entanglement threat to small children or infants. Further, the use of the second member may permit a window facing portion of the window covering to provide a roller-shade like aesthetic effect, which is an improvement over the visible and exposed lift cords or lifting tapes common on most conventional Roman shades.

It should be appreciated that other variations of the present preferred embodiments discussed above may be made. For example, it is contemplated that various spring motor arrangements may be utilized for actuation of the lifting and lowering of the window covering material. As another example, the material choices for the window covering material may be any suitable material desired by a consumer, retailer or designer.

While certain present preferred embodiments of my window covering and certain embodiments of methods of practicing the same have been shown and described, it is to be distinctly understood that the invention is not limited thereto but may be otherwise variously embodied and practiced within the scope of the following claims.

I claim:

1. A window covering comprising:

a mounting device;

a roller attached to the mounting device such that the roller is rotatable in a first direction and a second direction opposite the first direction;

an actuation device attached to the roller, the actuation device configured to move the roller to rotate the roller in at least one of the first direction and the second direction;

a front member comprised of window covering material, the front member having an upper portion and a lower portion, the upper portion of the front member attached to the mounting device, the front member moveable from a retracted position to an extended position;

a second member comprised of window covering material, the second member having an upper portion, a bottom portion, a first side and a second side opposite the first side; the upper portion of the second member attached to the roller such that rotation of the roller in the first direction winds the second member about the roller to retract the second member and rotation of the roller in the second direction unwinds the second member from the roller to extend the second member, the bottom portion of the second member attached to the bottom portion of the front member; and a plurality of generally U-shaped members, each U-shaped member having a first end portion, a second end portion, and a middle portion between the first end portion and the second end portion, the first end portion of each U-shaped member engaging or positioned within the front member, the second end portion of each U-shaped member extending from the middle portion to the second member to engage the second side of the second member; each U-shaped member being positioned such that each U-shaped member is substantially parallel to other U-shaped members; and the second end portions of the U-shaped members being sized and configured to cause the front member to form substantially parallel folds when the second member is wound about the roller to retract the front member to the retracted position.

2. The window covering of claim 1 wherein the actuation device is comprised of one of a loop cord drive attached to the roller, a spring clutch mechanism attached to the roller, and a spring clutch mechanism attached within the roller.

3. The window covering of claim 1 wherein retraction of the front member is simultaneous with retraction of the second member and wherein the actuation device actuates at least one of retraction of both the front member and the second member and extension of both the front member and the second member.

4. The window covering of claim 1 wherein the roller has a length and a diameter and the second member has a width and a length, the width of the second member being substantially equal to the length of the roller and the length of the second member being sized to define how low the front member extends from the mounting device.

5. The window covering of claim 1 wherein the first side of the second member is configured to face toward the front member when the second member is unwound from the roller;

wherein the mounting device is comprised of a headrail and wherein the roller is one of a shaft, a tube and a generally cylindrical structure; and wherein the roller has a length and a diameter and the second member has a width and a length, the width of the second member being substantially equal to the length of the roller and the length of the second member being sized to define how low the front member extends from the mounting device.

* * * * *